United States Patent [19]

Helms et al.

[11] 4,235,280

[45] Nov. 25, 1980

[54] SPRAY NOZZLE FOR COOLING A CONTINUOUSLY CAST STRAND

[75] Inventors: Jimmy L. Helms, Ridgewood, N.J.; Richard J. Tegtmeier, Pound Ridge, N.Y.

[73] Assignee: Concast Incorporated, Montvale, N.J.

[21] Appl. No.: 5,414

[22] Filed: Jan. 22, 1979

[51] Int. Cl.[3] ..... B22D 11/124

[52] U.S. Cl. ..... 164/444; 164/89

[58] Field of Search ..... 164/89, 444; 239/568, 239/597, 598; 72/201

[56] References Cited

U.S. PATENT DOCUMENTS

| | | | |
|---|---|---|---|
| 3,341,133 | 9/1967 | Hruby et al. | 239/598 |
| 3,499,456 | 3/1970 | Rerecich et al. | 164/444 X |
| 3,515,202 | 6/1970 | Bick et al. | 164/444 X |
| 3,766,963 | 10/1973 | Rossi | 164/89 |
| 3,877,510 | 4/1975 | Tegtmeier et al. | 164/89 X |
| 3,924,812 | 12/1975 | Miura et al. | 164/444 X |
| 3,935,896 | 2/1976 | Tegtmeier et al. | 164/89 |

FOREIGN PATENT DOCUMENTS 640437 7/1928 France .

*Primary Examiner*—Gil Weidenfeld

*Assistant Examiner*—Gus T. Hampilos

*Attorney, Agent, or Firm*—Tobias Lewenstein

[57] ABSTRACT

A continuous casting installation has a curved secondary cooling zone in which a partially solidified, continuously cast strand originally having a generally vertical orientation is turned towards the horizontal while being cooled. Spray nozzles are provided for spraying the upper and lower surfaces of the strand, as well as the sides of the strand, with cooling fluid during passage of the strand through the curved cooling zone. The spray nozzles for cooling the sides of the strand have slot-like openings which curve in the same direction as the curved cooling zone. These spray nozzles thus produce curved spray patterns. This makes it possible to reduce the number of spray nozzles required to cool the strand in the curved cooling zone thereby simplifying spray nozzle alignment problems. Furthermore, by appropriate selection of the radius of curvature of the slot-like openings, the spray nozzles for the sides of the strand may be positioned farther away from the strand than previously. This reduces the chances of damage to the nozzles in the event of rupture of the strand and an accompanying escape of molten material from the interior of the strand.

6 Claims, 3 Drawing Figures

FIG. 1
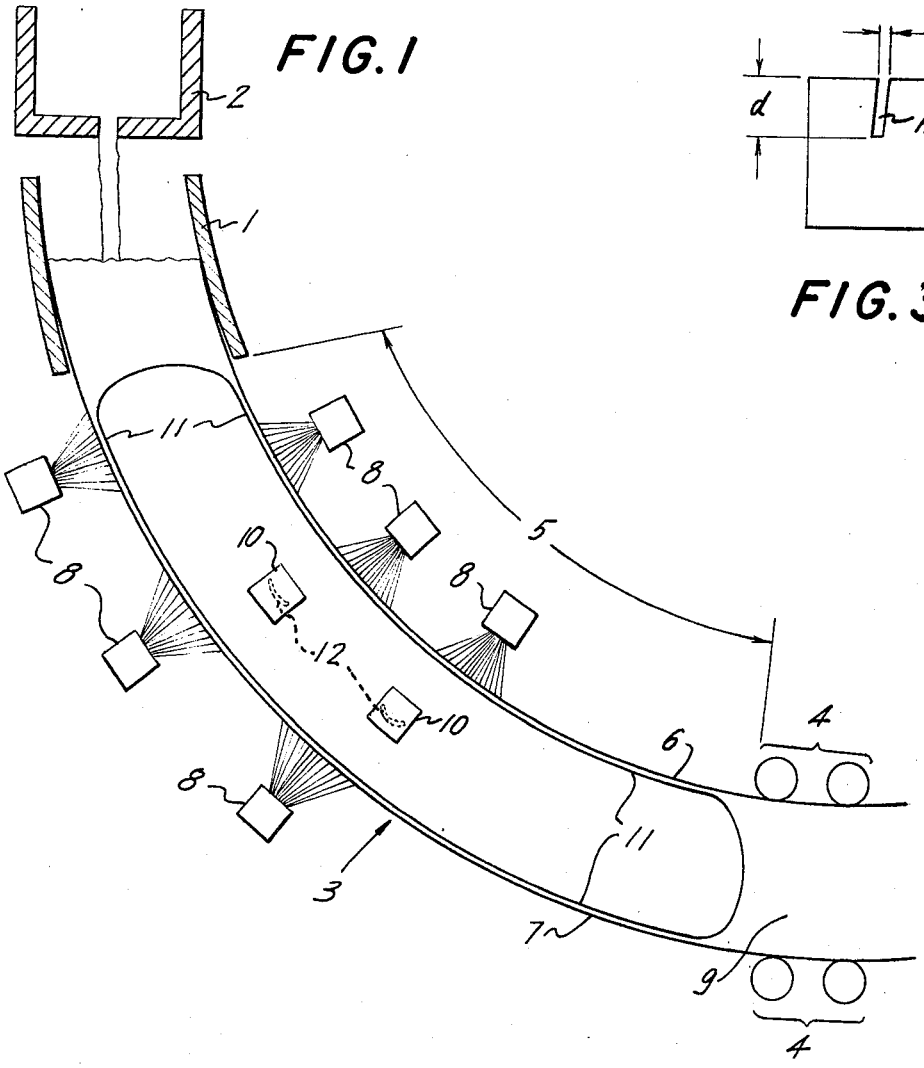
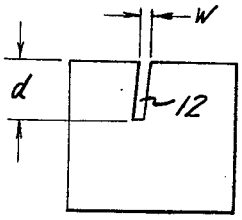
FIG. 3
FIG. 2
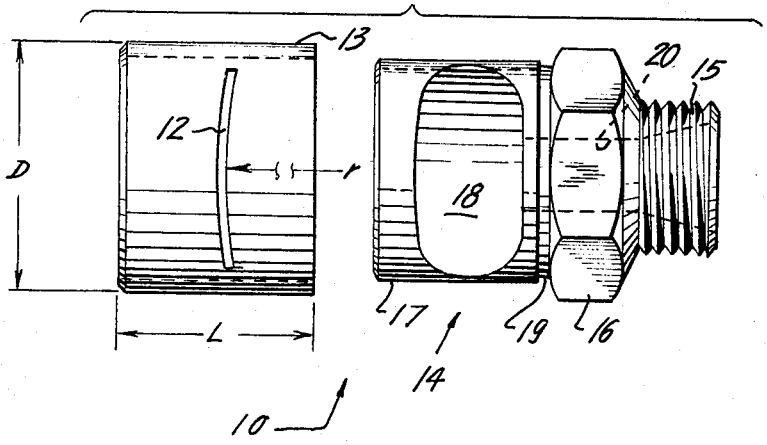

SPRAY NOZZLE FOR COOLING A CONTINUOUSLY CAST STRAND

FIELD OF THE INVENTION

The invention relates generally to the continuous casting of metals, especially steel.

More particularly, the invention relates to a nozzle and a method for the cooling of a continuously cast strand of metal issuing from a mold.

BACKGROUND OF THE INVENTION

A known apparatus for the continuous casting of metal includes a cooled, generally vertical, open-ended mold. Molten metal is continuously admitted into the mold form a suitable teeming vessel such as a tundish. The molten metal adjacent the walls of the mold solidifies thereby forming a shell with a molten core. The shell and its molten core are continuously withdrawn from the mold thus producing a long strand which, after complete solidification, is cut into lengths and then further processed.

In order to reduce the height of the apparatus, the strand is conveyed along a path which curves towards the horizontal. a straightener is located adjacent the point at which the transition from a vertical to a horizontal orientation is complete and straightens the strand which would otherwise maintain its curvature. After straightening, the strand is cut into lengths which are eventually conveyed to a mill for further processing.

It is necessary for the strand to be completely solidified before the cutting operation since otherwise molten metal will flow onto the casting apparatus and cause damage. Generally, it is attempted to obtain complete solidification prior to the straightening operation so as to eliminate the chance that the shell will rupture during straightening and permit molten metal to escape.

In order to solidify the strand throughout its cross-section, the strand is subjected to the direct action of cooling fluid sprays, typically water sprays, between the exit end of the mold and the entrance to the straightener. To this end, spray nozzles are arranged above and below the strand as well as to the sides of the strand. The direct cooling of the strand between the mold and the straightener is referred to as "secondary" cooling to distinguish it from the indirect, "primary" cooling which takes place at the walls of the mold. The zone between the mold and the straightener is correspondingly referred to as the "secondary cooling zone."

The distance between the mold and the straightener is relatively long and the length which can be sprayed by any one nozzle is limited. Accordingly, it is necessary to arrange a substantial number of nozzles along the length of the secondary cooling zone, both above and below the strand as well as to the sides thereof.

Inasmuch as underspraying or overspraying can be detrimental from a metallurgical point of view, the various nozzles must be correctly aligned. Due to the large number of nozzles, the alignment procedure is a time-consuming one. This problem is magnified for rectangular strands having a large width, i.e. slabs which have wide upper and lower surfaces. One reason resides in the inability of a single nozzle to spray across the entire width of such a strand. Thus, aside from the large number of nozzles which are in any event arranged along the length of the secondary cooling zone, one or more additional nozzles must be provided for each of the wide surfaces of the strand at every spraying location along this length. In other words, two or more nozzles directed at the wide surfaces of the strand are arranged side-by-side at each spraying location. The increased number of nozzles necessary here increases the alignment difficulties. Another reason that alignment problems are greater for strands of large width resides in that the casting apparatus is more complicated thereby hampering access to the nozzles.

An additional difficulty with the early prior art nozzles stems from the fact that it is necessary to position the nozzles relatively close to the strand in order to avoid overspraying. The close proximity of the nozzles to the strand makes them susceptible to damage in the event that the shell of the strand ruptures thereby permitting molten metal to escape.

In order to reduce the number of nozzles required to cool a rectangular strand of large width, it has been proposed to spray the wide surfaces of such a strand using a nozzle having an outlet opening in the form of a rectangular slot. The slot extends transversely to the longitudinal axis of the strand and is bounded by a pair of faces which extend perpendicular to the longitudinal axes of the strand and nozzle. These faces control the thickness of the spray pattern which is bounded by a pair of parallel lines extending transversely of the strand.

This slotted nozzle is capable of spraying greater widths than earlier prior art nozzles. Consequently, the plurality of nozzles arranged side-by-side at each spraying location along the secondary cooling zone may be replaced by a single slotted nozzle. The slotted nozzle may also be positioned farther away from the strand than the earlier nozzles thereby reducing the chances of damage to the nozzle in the event that the shell of the strand ruptures.

Although the slotted nozzle provides a good solution to the above problems for the spraying of the wide upper and lower surfaces of a large rectangular strand, it cannot satisfactorily spray the sides of a curved strand. Consequently, it neither permits a reduction in the number of nozzles required for spraying the sides of a curved strand nor overcomes the proximity problem for the nozzles used to spray such sides. Moreover, for narrow strands such as billets which require only a single nozzle for each surface at any spraying location along the secondary cooling zone, the slotted nozzle results in no reduction whatsoever in the number of nozzles.

OBJECTS OF THE INVENTION

It is an object of the invention to provide a nozzle and a method which make it possible to reduce the number of nozzles required to cool the sides of a curved, continuously cast strand.

Another object of the invention is to provide a nozzle and a method for cooling the sides of a curved, continuously cast strand which enable the nozzle to be positioned farther away from the sides of the strand than heretofore.

An additional object of the invention is to provide a nozzle and a method for cooling the sides of a curved, continuously cast strand which enable nozzle alignment problems to be simplified.

SUMMARY OF THE INVENTION

The above objects, and others which will become apparent, are achieved by the invention.

According to the invention, a continuous casting installation having a curved cooling zone includes a nozzle which is located laterally of the zone. The nozzle is provided with a slot-like outlet opening and at least a portion of the opening is arcuate and curves in the same direction as the zone. In this manner, a spray pattern is formed having a curvature at least approximating that of the cooling zone.

By providing for at least a portion of the nozzle outlet opening to curve in the same direction as the cooling zone, it becomes possible to produce a curved spray pattern with one nozzle. Since the prior art required several nozzles arranged on a curve to produce such a spray pattern, it is apparent that the novel nozzle is capable of replacing a plurality of prior art nozzles. This simplifies the structure of a continuous casting installation having a nozzle in accordance with the invention. Furthermore, since the novel nozzle makes it possible to replace several prior art nozzles with one nozzle and, in addition, has a simple design, the nozzle of the invention enables nozzle alignment problems to be reduced. Moreover, appropriate selection of the radius of curvature of the nozzle outlet opening permits the nozzle in accordance with the invention to be positioned farther away from the sides of a strand than the prior art nozzles. This makes it possible to reduce the chances of damage to the nozzle in the event that the shell of the strand ruptures and permits molten metal to escape.

A method according to the invention involves conveying a continuously cast strand along a curved path and impinging the strand with a cooling fluid spray pattern having a curvature at least approximating that of the path. The spray pattern is formed by directing cooling fluid through a slot-like opening located laterally of the path, and at least a portion of the opening is arcuate and curves in the same direction as the path.

BRIEF DESCRIPTION OF THE DRAWING

FIG. 1 is a schematic, partially sectional side view of a continuous casting installation provided with spray nozzles according to the invention;

FIG. 2 is a perspective view of a disassembled spray nozzle in accordance with the invention; and FIG. 3 is a side view of a component of the spray nozzle of FIG. 2.

DESCRIPTION OF THE PREFERRED EMBODIMENTS

FIG. 1 illustrates a continuous casting installation which is here assumed to be intended for the continuous casting of steel. Since the details of continuous casting installations are well-known, only those portions of the structure necessary for an understanding of the invention have been shown.

The installation includes a generally vertical, open-ended mold 1 which continuously receives molten steel from a teeming vessel 2, such as a tundish, positioned above the mold 1. The walls of the mold 1 are cooled and the molten steel adjacent the walls solidifies to form a shell which surrounds a molten core. The composite of shell and molten core is continuously withdrawn from the mold 1 thereby generating a continuously cast strand 3. The withdrawing function is performed by means of a withdrawal and straightening unit 4. cooling zone 5 in which it is subjected to the direct action of a cooling fluid, typically water, in order to solidify the molten core. In the present illustration, the mold is of the curved type and the secondary cooling zone 5 is curved in its entirety and forms a continuation of the curvature of the mold 1. Thus, as the strand 3 travels from the mold 1 towards the withdrawal and straightening unit 4, it is continuously turned from a generally vertical orientation towards the horizontal. The withdrawal and straightening unit 4 forcibly straightens the strand 3 once this has attained a horizontal orientation in order to eliminate the tendency of the strand 3 to continue along a curved path.

The mold 1 may be of the straight, vertical type instead of the curved type and, in such an event, the strand 3 initially travels along a straight, vertical path upon exiting from the mold 1. The strand 3 is subsequently bent and then travels along a curved path until it achieves a horizontal orientation at which time it is straightened. In an installation of this type, the secondary cooling zone thus includes a straight, vertical portion and a curved portion downstream of the vertical portion.

For ease of description, it is here assumed that the mold 1, and consequently the strand 3, have square or rectangular cross-sections. However, the invention is applicable to all cross-sectional configurations.

The strand 3 has a pair of opposed, curved surfaces 6 and 7. The surface 6 is here considered to form the upper surface of the strand 3 whereas the surface 7 is considered to form the lower surface of the strand 3. In the secondary cooling zone 5, the upper surface 6 and lower surface 7 of the strand 3 are sprayed with cooling fluid delivered from conventional nozzles 8 located above the upper surface 6 and beneath the lower surface 7.

The strand 3 further has a pair of opposed, generally planar surfaces 9. The planar surfaces 9, of which only one is shown, form the sides of the strand 3 and are respectively located in generally vertical planes. In the secondary cooling zone 5, the planar surfaces 9 are each sprayed with cooling fluid delivered from one or more nozzles 10 in accordance with the invention. The nozzles 10 are located laterally of the secondary cooling zone 5 and are spaced from the planar surfaces 9 by a suitable distance.

Due to the curvature of the strand 3, the upper and lower edges of the planar surfaces 9 are curved. According to the invention, the spray patterns 11 produced by the nozzles 10 are made to conform at least approximately to curved outlines of the planar surfaces 9. This is achieved in that each of the nozzles 10 is formed with a slot-like outlet opening 12 which curves in the same direction as the upper and lower edges of the planar surfaces 9. Since the curvature of the upper and lower edges of the planar surfaces 9 conforms to the curvature of the secondary cooling zone 5, it follows that the outlet openings 12 of the nozzles 10 curve in the same direction as the secondary cooling zone 5.

The construction of the nozzles 10, which is conventional except for the outlet openings 12, is shown in FIGS. 2 and 3.

As best seen in FIG. 2, a nozzle 10 of the invention includes a cylindrical sleeve 13 and a core 14. The outlet opening 12 of the nozzle 10 is provided in the sleeve 13.

The core 14 includes a threaded portion 15 which threads into a conventional header for cooling fluid. Adjacent the threaded portion 15, the core 14 is provided with an hexagonal head 16 which permits the nozzle 10 to be tightened in the header by means of a wrench or other appropriate tool. The core 14 further includes a cylindrical portion 17 which is received in the sleeve 13 and has a discharge opening 18. An annular seat 19 for a seal such as an O-ring is located between the head 16 and the cylindrical portion 17 of the core 14. An open-ended passage 20 extends from the cylindrical portion 17 of the core 14 through the threaded portion 15. The passage 20 provides communication between the header and the discharge opening 18 when the core 14 is threaded into the header. Cooling fluid is thus able to flow from the header to the discharge opening 18 and thence through the outlet opening 12 in the sleeve 13.

The sleeve 13 and core 14 may be held together in any convenient manner. For example, the sleeve 13 and core 14 may be fastened to one another using a screw.

The radius of curvature of the secondary cooling zone 5 will depend upon various factors including the sizes to be cast. Thus, the secondary cooling zones of continuous casting installations currently in use have radii of curvature which vary from as little as about 8 feet to as much as approximately 50 feet.

Tests have demonstrated that the radius of curvature "r" of the outlet opening 12 of the nozzle 10 may be substantially smaller than the radius of curvature of the secondary cooling zone 5. In fact, the radius of curvature "r" is desirably only a small fraction of the radius of curvature of the secondary cooling zone 5. The reason is that, in order to spray a given area of the strand 3, a small radius "r" requires the nozzle 10 to be positioned farther away from the strand 3 than a large radius "r." This reduces the chances of damage to the nozzle 10 in the event that the shell of the strand 3 ruptures and permits molten metal to escape. A preferred range for the radius "r" is about ½ inch to about 5 inches. A corresponding range for the ratio or "r" to the radius of curvature of the secondary cooling zone 5 is from about 1:1200 to about 1:20.

The distance between the nozzle 10 and the strand 3 in a particular situation is determined by experimentation and calculation similar to that used currently for positioning the nozzles of the prior art.

The curved spray pattern 11 produced by the nozzle 10 of the invention makes it possible for one nozzle 10 to replace a plurality of the prior art nozzles currently used to spray the sides of a curved strand. Thus, to produce a curved spray pattern in the prior art, a plurality of nozzles must be arranged along a curve having a curvature which corresponds to that of the secondary cooling zone 5. The nozzle 10 according to the invention may, depending upon the circumstances, replace up to ten prior art nozzles.

Since the nozzle 10 of the invention permits the number of nozzles to be reduced, a reduction in alignment problems may be realized due to the fact that a smaller number of nozzles need to be aligned. A further contribution to a reduction in alignment problems stems from the fact that the design of the nozzle 10 of the invention makes the nozzle 10 itself simple to align.

It is known that it may at times be desirable for the intensity of the cooling effect to decrease with increasing distance from the mold 1. This may be accomplished by positioning the nozzle 10 so that the end of the outlet opening 12 nearest the mold 1 is closer to the strand 3 than the end farthest away from the mold 1.

In order to illustrate the design of the outlet opening 12 of the nozzle 10, a set of dimensions is presented below. However, since the design of the outlet opening 12 will vary depending upon the application, the listed dimensions are nothing more than broadly illustrative and are not intended to limit the invention. With reference to FIGS. 2 and 3, the pertinent dimensions in inches are as follows:

Outer diameter of sleeve 13, D—1.75
Length of sleeve 13, L—1.24
Maximum depth of outlet openig 12, d—0.475
Width of outlet opening 12, w—0.067
Radius of outlet opening 12, r—3.0

Various modifications are possible within the scope of the invention. For instance, the secondary cooling zone 5 and outlet opening 12 of the nozzle 10 have each been illustrated as having a constant radius of curvature. However, straight-mold casting installations with bending to the horizontal are known in which bending takes place progressively. In other words, an initially straight, vertical strand is bent such that its radius decreases in increments to a final radius which is maintained until the strand is straightened. If a nozzle 10 according to the invention is positioned in the region where the radius of the strand is changing progressively, it may be desirable for the outlet opening 12 of the nozzle 10 to correspondingly have a varying radius.

Furthermore, instead of being curved in its entirety as illustrated, it is possible for only a portion of the outlet opening 12 to be curved. This may be desirable in a vertical, straight-mold casting installation with bending to the horizontal in one step. Here, a nozzle 10 according to the invention might be positioned in the region of the transition from a straight, vertical path to a curved path. It may then be advantageous for the outlet opening 12 to have a curved portion for spraying along the curved path and a straight portion for spraying along the vertical path.

We claim:

1. A continuous casting installation comprising:

(a) an open-ended mold having a non-horizontal casting passage for forming a continuously cast strand;

(b) a zone, defined by cooling means for cooling a strand emerging from said mold and passing through said zone, located outside of said mold which zone curves along on arcuate path towards the horizontal and is arranged to receive the strand formed in said mold;

(c) conveying means associated with said zone for conveying the strand through said zone; and (d) said cooling means defining said zone supplying cooling fluid to said zone so as to cool the strand, said cooling means including at least one nozzle provided with a slot-like opening defined by a portion of said nozzle for providing cooling fluid to said zone, and at least a portion of said opening being arcuate, said portion of said opening being formed so as to produce a curved spray pattern, and said nozzle being located laterally of said zone and being arranged such that the spray pattern emitted via said arcuate portion of said opening at least approximately follows the curvature of said zone, said zone having a first radius of curvature and said arcuate portion of said opening having a second radius of curvature, and the ratio of said second radius of curvature to said first radius of curvaturebeing substantially smaller than unity.

2. The installation of claim 1 in which said opening is curved in its entirety.

3. The installation of claim 1 in which said ratio is a minimum of about 1:1200.

4. The installation of claim 1 in which said ratio is a maximum of about 1:20.

5. The installation of claim 1 in which said zone and said portion of said opening have constant radii of curvature.

6. The installation of claim 1 in which said zone and said portion of said opening have varying radii of curvature.

* * * * *